US006561791B1

(12) United States Patent
Vrolijk et al.

(10) Patent No.: US 6,561,791 B1
(45) Date of Patent: May 13, 2003

(54) GAS BURNER REGULATING SYSTEM

(75) Inventors: Enno Vrolijk, Dalen (NL); Tom Gerretsen, Emmen (NL)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/701,664

(22) PCT Filed: May 27, 1999

(86) PCT No.: PCT/EP99/03670

§ 371 (c)(1), (2), (4) Date: Mar. 5, 2001

(87) PCT Pub. No.: WO99/63272

PCT Pub. Date: Dec. 9, 1999

(30) Foreign Application Priority Data

Jun. 2, 1998 (DE) ..... 198 24 521

(51) Int. Cl.[7] ..... F23N 1/02
(52) U.S. Cl. ..... 431/12; 431/89; 431/90
(58) Field of Search ..... 431/90, 12, 89, 431/76, 80, 20; 236/15 BD, 15 BB, 15 E

(56) References Cited

U.S. PATENT DOCUMENTS 4,645,450 A * 2/1987 West ..... 431/90
5,401,162 A * 3/1995 Boone ..... 431/90
5,520,533 A * 5/1996 Vrolijk ..... 431/90

FOREIGN PATENT DOCUMENTS

JP 58-224226 * 12/1983 ..... 431/90
JP 60-122818 * 7/1985 ..... 431/90

* cited by examiner

*Primary Examiner*—James C. Yeung
(74) *Attorney, Agent, or Firm*—Kris T. Fredrick

(57) ABSTRACT

The invention relates to a regulating system for a gas burner. Regulating systems for gas burners are used for guiding a gas flow and a combustion air flow to the burner. The gas flow can be regulated depending on combustion air pressure. Pressure is measured in known regulating devices with the aid of a membrane, that is pneumatically. The pneumatic pressure measurement limits the scope of application of known regulating devices. In the invention regulating device, a sensor (16) is arranged between a first line (10) guiding a gas flow and a second line (12) guiding the combustion air flow, an electric or electronic signal (19) being generated by the sensor that is used to regulate the gas valve (11).

15 Claims, 2 Drawing Sheets

GAS BURNER REGULATING SYSTEM

BACKGROUND OF THE INVENTION

This invention relates to a regulating device for gas burners. Regulating devices for gas burners serve to provide a gas-air mixture, which supplies a gas stream and a combustion air stream to a burner. According to various embodiments described herein, the gas stream is capable of being set as a function of the combustion air pressure by means of a gas valve.

Regulating devices for gas burners of the above type are well known from the prior art. In one regulating device, the pressure is determined with the aid of a diaphragm, or pneumatically. See EP 0 390 964 A1. The gas stream is regulated by means of the gas valve as a function of this pressure measurement. However, the one disadvantage with this pneumatic method is that it restricts the scope of use of known regulating devices. In such devices the hysteresis properties of the diaphragm and the forces acting between the diaphragm and the gas valve restrict the working range and therefore the scope of use. Furthermore, the interaction between the low actuating forces and the operating tolerances of the diaphragm as a result of disturbing influences, such as temperature fluctuations or the like, cause a restriction in the scope of use of known regulating devices.

There are other regulating devices for gas burners found in the prior are with similar disadvantages. See DE 24 27 819 A1 and DE 43 17 981 A1.

SUMMARY OF INVENTION

The present invention attempts to provide a regulating device for gas burners, which avoids the disadvantages of known devices, thus providing a greater scope of use. Various embodiments described herein solve the scope of use problem by means of a regulating device for gas burners.

DETAILED DESCRIPTION OF THE INVENTION

Figure 1:
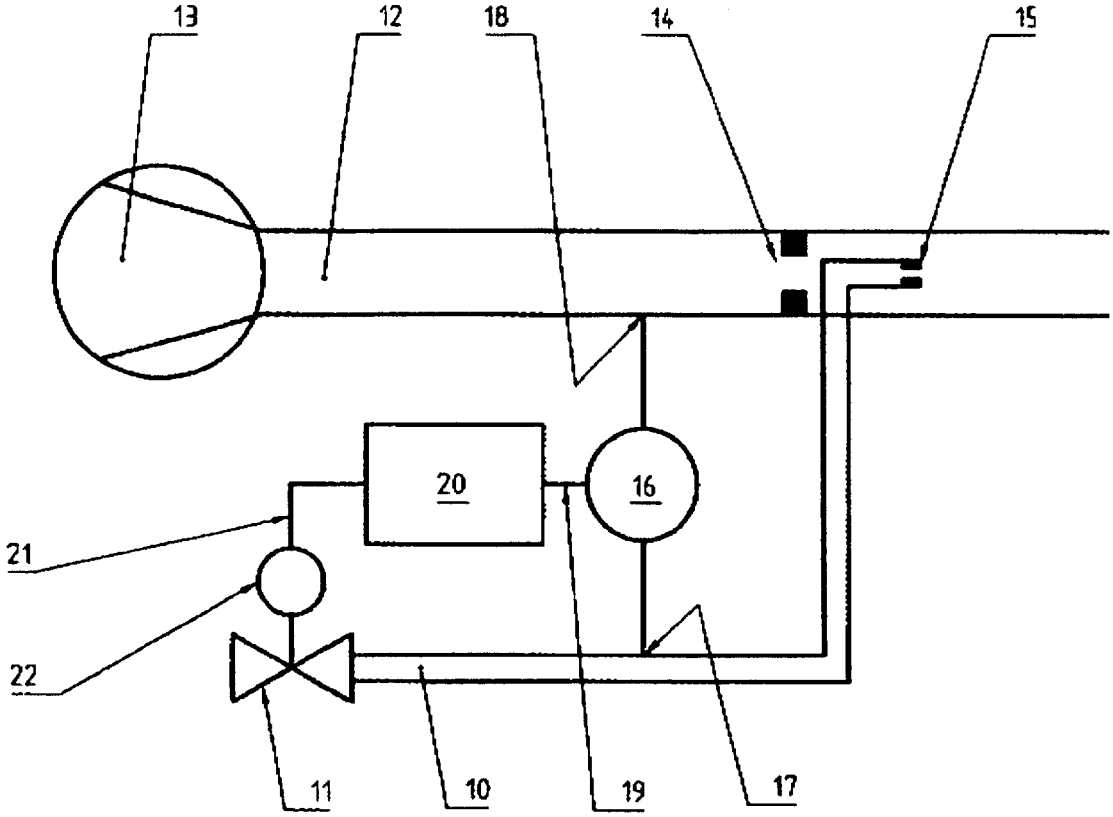
FIG. 1 is a first embodiment of a regulating device for a gas burner system.

The present invention relates to regulating devices for gas burners. A gas/air mixture is to be supplied to a burner(not illustrated). In FIG. 1, a first line 10 supplies a gas stream to a gas burner. The gas stream in the first line 10 flows from a valve 11 to a gas nozzle 15.

A second line 12 supplies a combustion air stream to the gas burner. The combustion air in the second line 12 flows from a blower 13. The rotational speed of the blower 13 determines the combustion air pressure, and therefore the combustion air stream. The second line 12 contains a throttle point 14 upstream of the gas nozzle 15. The gas stream in the first line 10 exits from the nozzle 15 into the second line 12. Therefore, a gas/air mixture exists downstream of the gas nozzle 15 in the direction of the combustion air stream.

The embodiment illustrated by FIG. 1 provides a combined 1:1 gas/air mixture regulation. Thus, if the combustion air pressure increases 1 millibar (mbar), the gas pressure will likewise increase by 1 mbar. A sensor 16 located between the first line 10 and the second line 12 provides the combined 1:1 gas/air mixture regulation. The sensor 16 functions as a differential pressure sensor, of the flowmeter or anemometer type.

The sensor 16 is connected to the first line 10 by means of a first measuring point 17. The sensor 16 is connected to the second line 12 by means of a second measuring point 18. The first measuring point 17 is positioned upstream of the gas nozzle 15. The second measuring point 18 is positioned upstream of the throttle point 14.

To accomplish the combined 1:1-gas/air regulation presented in the FIG. 1 embodiment, the gas pressure must equal the combustion air pressure. Thus, when the sensor 16 is a flowmeter or anemometer, the flow through the sensor 16 will be zero. If, for example, the combustion air pressure decreases in relation to the gas pressure, the sensor 16 experiences a throughflow from the first line 10 in the direction of the second line 12. By contrast, if the combustion air pressure increases in relation to the gas pressure, the sensor 16 experiences a throughflow from the second line 12 in the direction of the first line 10. Accordingly, based on the throughflow quantity and direction, the sensor 16 can determine the pressure ratios between the combustion air pressure and the gas pressure. The sensor 16 generates, as a function of these pressure ratios, an electric or electronic signal 19 that adjusts the gas valve 11. According to FIG. 1, the signal 19 is supplied to a control or regulating unit 20 which generates a regulating signal 21 for an actuating drive 22 of the gas valve 11.

Consequently, the regulating device of FIG. 1, regulates the gas stream using the gas valve 11 to achieve combined 1:1-gas/air regulation. When the sensor 16 detects a pressure differential of zero between the combustion air pressure and gas pressure, the signal 19 corresponds to a pressure difference of zero and the gas valve 11 operates unchanged. When the sensor 16 detects a combustion air pressure higher than the gas pressure, the signal 19 will activate the gas valve 11 so that the gas stream is increased. This is accomplished by the regulating unit 20 generating a regulating signal 21 for the actuating drive 22 of the gas valve 11, so that the signal 19 corresponds to a pressure difference of zero. By contrast, when the sensor 16 detects a combustion air pressure lower than the gas pressure, the signal 19 activates the gas valve 11 so that the gas stream is decreased.

The gas valve 11 may be designed in a variety of ways. For example, the actuating drive 22 of the gas valve 11 is controlled or regulated so the gas valve 11 switches between the on/off or open/shut states. If the combustion air pressure is higher than the gas pressure, a regulating signal 21 is generated, causing either the actuating drive 22 to open or the gas valve 11 to activate. Likewise, if the combustion air pressure is lower than the gas pressure, the actuating drive 22 will close or deactivate the gas valve 11 based on the regulating signal 21. A resulting oscillating signal provides information on the proper operation of the regulating system, thus it and can function as a safety signal. With the oscillating sensor signal present, a safety valve (not illustrated) preceding the gas valve 11 can be activated or opened.

Alternatively, it is also possible to activate the gas valve 11 to assume any desired opening positions between the on/off or open/shut states. The regulating device of FIG. 1 can be used for air quantity measurement when the gas valve 11 is closed. This is because the sensor 16 has the second measuring point 18 on the second line 12, upstream of the throttle point 14 in the flow direction of the combustion air. Furthermore, the sensor 16 has the first measuring point 16 on the first line 10 downstream of the throttle point 14 and the gas valve 11 is closed. If the gas valve 11 is closed, the pressure difference across the throttle point 14 can be determined by the sensor 16, and an air quantity can be measured.

The air quantity measurement can be used to set the parameter range of the blower 13 as a function of a configuration of the combustion air supply and smoke gas discharge. The air quantity measurement also can be used to monitor and set a minimum combustion air supply, which is required to reliably start the gas burner.

Figure 2:
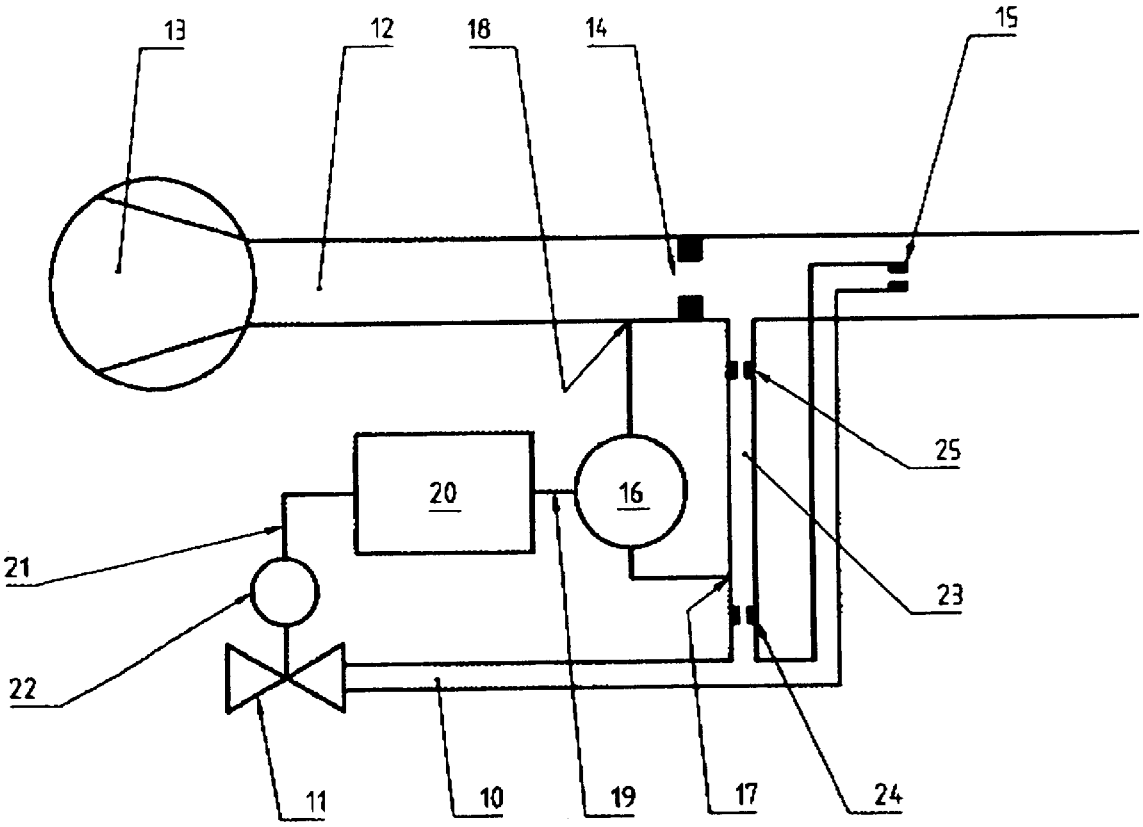
FIG. 2 is a second embodiment of a regulating device for a gas burner system.

FIG. 2 illustrates another embodiment of a regulating device for a gas burner system that provides combined 1:N gas/air regulation. This is accomplished by using a different transmission ratio in the FIG. 2 embodiment than in the FIG. 1 embodiment. In FIG. 2, a coupling line 23 is positioned between a first line 10 supplying the gas stream and a second line 12 supplying the combustion air stream. In the coupling line 23 there is a first contraction 24 and a second contraction 25. The first contraction 24 and the second contraction 25 are throttle points.

No specific position of the first contraction 24 and the second contraction 25 within the coupling line 23 in relation to the first line 10 and the second line 12 is required. However, the flow resistance of the first line 10 and the second line 12 must be noticeably lower than the flow resistance of the first contraction 24 and the second contraction 25.

In FIG. 2, the coupling line 23 is connected to the second line 12 downstream of the throttle point 14 in the direction of flow of the combustion air. The coupling line 23 is connected to the first line 10 upstream of the gas nozzle 15 in the direction of flow of the gas.

In the FIG. 2 embodiment, like in the FIG. 1 embodiment, a sensor 16 is positioned between the first line 10 and the second line 12. However, in FIG. 2, a first measuring point 17 is positioned in the coupling line 23 between the first contraction 24 and the second contraction 25. A second measuring point 18 is positioned in the second line 12 upstream of the throttle point 14.

In FIG. 2, a regulating unit 20 generates a regulating signal 21 for an actuating drive 22 of the gas valve 11, so that a signal 19 from the sensor 16 corresponds to a pressure difference of zero. However, because of the arrangement of the coupling line 23 with the first contraction 24 and the second contraction 25, combined 1:N-gas/air regulation can be implemented. Thus, an increase in the combustion air pressure of 1 mbar will increase the gas pressure by N mbar.

Consequently, in FIG. 2, the gas pressure is intensified in relation to the combustion air pressure. The degree of intensification is determined by the first contraction 24 and the second contraction 25.

Furthermore, either the first contraction 24 or the second contraction 25 may be designed to be variable or modifiable. In that case, it is possible, by modifying or adjusting either the first contraction 24 or the second contraction 25, to vary the transmission ratio between the combustion air stream and the gas stream, or the intensification.

List of reference symbols

| | |
|---|---|
| 10 | First Line |
| 11 | Gas valve |

-continued

List of reference symbols

| | |
|---|---|
| 12 | Second Line |
| 13 | Blower |
| 14 | Throttle point |
| 15 | Gas nozzle |
| 16 | Sensor |
| 17 | First Measuring point |
| 18 | Second Measuring point |
| 19 | Signal |
| 20 | Regulating unit |
| 21 | Regulating signal |
| 22 | Actuating drive |
| 23 | Coupling line |
| 24 | First Contraction |
| 25 | Second Contraction |

What is claimed is:

1. A regulating device for a gas burner system, the gas burner system including a first line through which a gas stream flows from a gas valve to a gas nozzle, and a second line through which a combustion air stream flows from a blower, the gas nozzle located downstream from the blower and a throttle point in the second line, the regulating device comprising, in combination:

a first measuring point on the first line, the first measuring point positioned upstream from the gas nozzle;

a second measuring point on the second line, the second measuring point positioned upstream of the throttle point;

a sensor coupled to the first measuring point and the second measuring point, the sensor providing a signal indicating a pressure differential; and a control unit operative to provide a regulating signal to an actuating drive for controlling the gas valve.

2. The regulating device of claim 1, wherein the actuating drive associated with the gas valve receives the regulating signal generated as a function of the signal indicating the pressure differential.

3. The regulating device of claim 1, wherein an oscillating signal results from the regulating signal and can be monitored to ensure proper operation of the regulating device.

4. A regulating device for a gas burner system, the gas burner system including a first line through which a gas stream flows from a gas valve to a gas nozzle, and a second line through which a combustion air stream flows from a blower, the gas nozzle located downstream from the blower and a throttle point in the second line, the regulating device comprising, in combination:

a coupling line connected to the second line downstream of the throttle point and the first line upstream of the gas nozzle, the coupling line containing a first contraction and a second contraction, the first contraction controlling the amount of gas being supplied to the coupling line, the second contraction controlling the amount of air being supplied to the coupling line;

a first measuring point on the coupling line, the first measuring point positioned between the first contraction and the second contraction;

a second measuring point on the second line, the second measuring point positioned upstream of the throttle point;

a sensor coupled to the first measuring point and the second measuring point, the sensor providing a signal indicating a pressure differential; and a control unit operative to provide a regulating signal to an actuating drive for controlling the gas valve.

5. The regulating device of claim 4, wherein at least one of the first contraction and the second contraction is adjustable.

6. The regulating device of claim 4, wherein a transmission ratio between the gas stream and the combustion air stream is modified by an adjustable first contraction or an adjustable second contraction.

7. The regulating device of claim 4, wherein the regulating signal produces an oscillating signal that can be monitored to ensure proper operation of the regulating system.

8. A method for regulating a gas-air mixture to a gas burner system, the gas burner system including a first line through which a gas stream flows from a gas valve to a gas nozzle, and a second line through which a combustion air stream flows from a blower, the gas nozzle located downstream from the blower and a throttle point in the second line, comprising in combination:

providing a signal indicating a differential pressure between the first line and the second line; and regulating an actuating drive based on the signal, thereby controlling the gas valve.

9. The method of claim 8, wherein the differential pressure is measured between a first measuring point positioned upstream from the gas nozzle and a second measuring point positioned upstream from the throttle point.

10. The method of claim 8, wherein regulating the actuating drive includes receiving the signal indicating the pressure differential and providing a regulating signal to the actuating drive.

11. The method of claim 8, wherein monitoring the regulating signal includes monitoring a resulting oscillating signal to ensure proper operation of the regulating system.

12. A method for regulating a gas-air mixture to a gas burner system, the gas burner system including a first line through which a gas stream flows from a gas valve to a gas nozzle and a second line through which a combustion air stream flows from a blower, the gas nozzle located downstream from the blower and a throttle point in the second line, the system further including a coupling line connected to the second line downstream of the throttle point and the first line upstream of the gas nozzle, the coupling line containing a first contraction and a second contraction, the method comprising in combination:

providing a signal indicating a differential pressure between the second line and the coupling line; and regulating an actuating drive based on the signal, thereby controlling the gas valve.

13. The method of claim 12, wherein the differential pressure is measured between a first measuring point positioned between the first contraction and the second contraction and a second measuring point positioned upstream of the throttle point.

14. The method of claim 12, wherein modifying a transmission ratio between the gas stream and the combustion air stream includes adjusting either the first or second contraction.

15. The method of claim 12, wherein monitoring the regulating signal includes monitoring a resulting oscillating signal to ensure proper operation of the regulating system.

* * * * *